US005813762A

United States Patent [19]

Fleischli et al.

[11] Patent Number: 5,813,762

[45] Date of Patent: Sep. 29, 1998

[54] MIXER TUBE FOR LOW VISCOSITY FLUIDS

[75] Inventors: Markus Fleischli, Winterhur; Gottlieb Schneider, Seuzach; Marc Bruno Wehrli, Winterhur, all of Switzerland

[73] Assignee: Sulzer Chemtech AG, Winterhur, Switzerland

[21] Appl. No.: 808,380

[22] Filed: Feb. 28, 1997

[30] Foreign Application Priority Data

Apr. 12, 1996 [EP] European Pat. Off. ..... 96810224

[51] Int. Cl.[6] ..... B01F 5/06

[52] U.S. Cl. ..... 366/337; 366/336; 138/42

[58] Field of Search ..... 366/336, 337, 366/338, 340, 341; 138/37, 38, 42; 165/109.1; 48/189.4

[56] References Cited

U.S. PATENT DOCUMENTS

| | | | |
|---|---|---|---|
| 3,409,187 | 11/1968 | Socha | 366/336 |
| 4,040,256 | 8/1977 | Bosche et al. | 366/337 |
| 4,062,524 | 12/1977 | Brauner . | |
| 4,220,416 | 9/1980 | Brauner et al. | 366/337 |
| 4,758,098 | 7/1988 | Meyer | 366/337 |
| 4,765,204 | 8/1988 | Buchholz et al. | 366/337 |
| 4,929,088 | 5/1990 | Smith | 366/337 |
| 4,936,689 | 6/1990 | Federighi et al. | 366/337 |
| 5,378,063 | 1/1995 | Tsukada | 366/337 |
| 5,456,533 | 10/1995 | Streiff et al. | 366/337 |
| 5,492,408 | 2/1996 | Alfare | 366/337 |
| 5,522,661 | 6/1996 | Tsukada | 366/337 |

FOREIGN PATENT DOCUMENTS

| | | | |
|---|---|---|---|
| 2 311 578 | 12/1976 | France . | |
| 2 313 113 | 12/1976 | France . | |
| 24309 | 3/1914 | Norway | 366/377 |
| 669 336 | 3/1989 | Switzerland . | |
| 678284 | 8/1991 | Switzerland . | |

*Primary Examiner*—Tony G. Soohoo
*Attorney, Agent, or Firm*—Townsend and Townsend and Crew LLP

[57] ABSTRACT

The mixer tube for low viscosity fluids contains plate-shaped elements which at one or at several points of the tube partially cover or block off its cross-section. The constrictions left free through the elements each comprise at least one gap-shaped region, with a longitudinal extent of this gap extending from tube wall to tube wall through the tube axis or from the tube wall through the tube axis to a second partial region. The gap subtends an angle with the tube axis in the range between about 20° and 60°, preferably between 35° and 45°. A mixing path is provided after the constriction in the direction of flow. The fluid to be mixed can contain solid substances in suspension.

29 Claims, 2 Drawing Sheets

Fig. 4
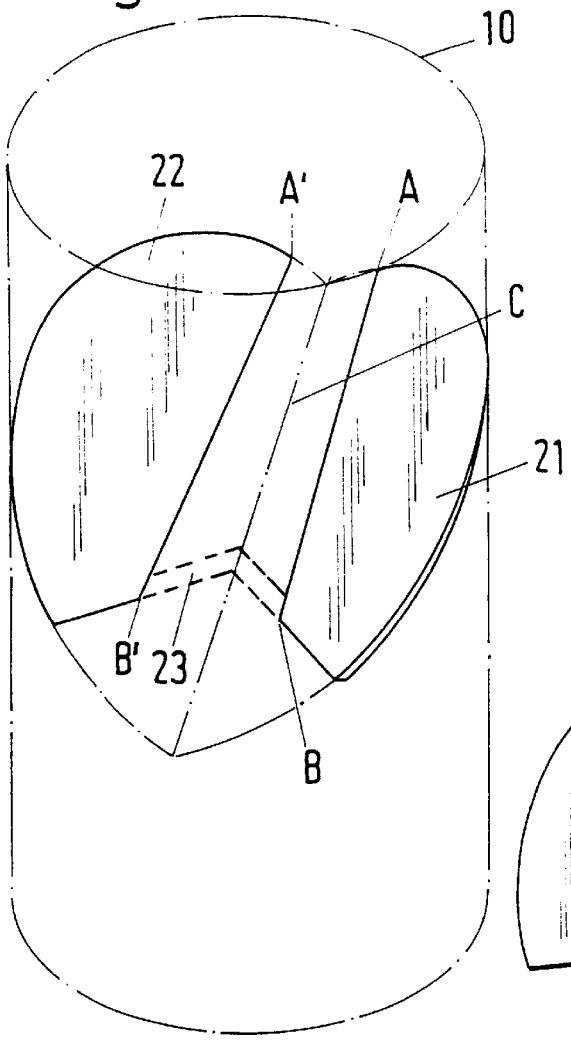
Fig. 8
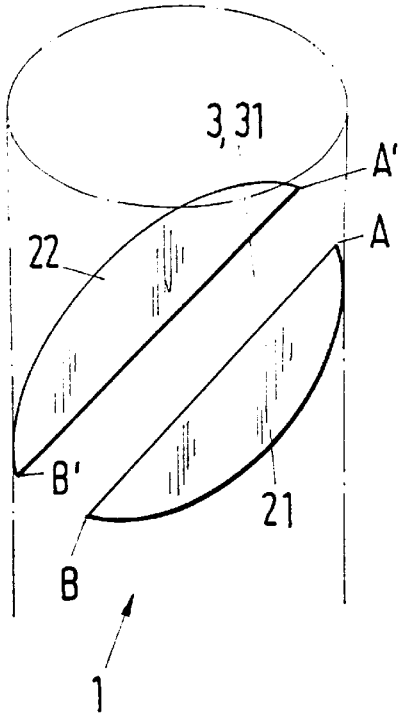
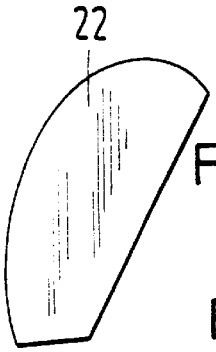
Fig. 5
Fig. 7
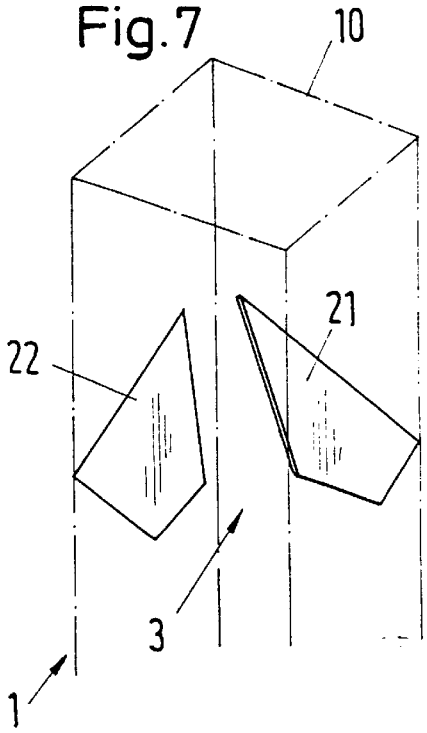
Fig. 6
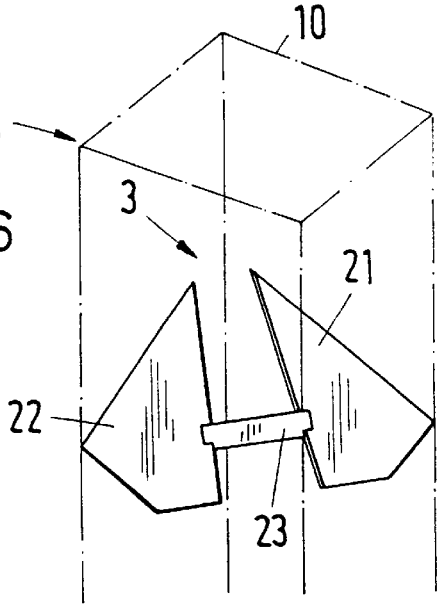

MIXER TUBE FOR LOW VISCOSITY FLUIDS

BACKGROUND OF THE INVENTION

The invention relate s to a mixer tube for low viscosity fluids, in particular for fluids with solid substances held in suspension.

A static mixer apparatus is known from CH-PS 669 336 by means of which fluids containing solid particles can be mixed without congestion occurring. This apparatus comprises mixer elements in a tube, each of which consists of two outer flanges and at least one inner flange. The flanges are gaplessly connected to the housing at their one ends or sides, whereas their other ends terminate at a distance from the tube wall. Adjacent flanges cross one another, with an intermediate space remaining free at each crossing point. The mixing takes place substantially within the mixer elements through a cross-wise deflection of individual partial flows.

SUMMARY OF THE INVENTION

The object of the invention is to provide a mixer tube with static inserts which can be manufactured more economically in comparison with the known mixer apparatus. This object is satisfied by providing a mixer tube in which the mixing takes place as a result of the constrictions or narrow passages and of the mixing paths adjoining the constrictions. A mixer apparatus of this kind can also be used for low viscosity fluids which contain no solid substances.

The mixer tube in accordance with the invention for low viscosity fluids contains plate-shaped elements which at one or at individual positions on the tube partially cover or block off its cross-section. The constrictions left free by the elements each encompass at least one gap-shaped region, with a longitudinal extent of this gap extending from tube wall to tube wall through the tube axis or from the tube wall through the tube axis to a second partial region. The gap subtends an angle with the tube axis in the range between about 20° and 60°, preferably between 35° and 45°. A mixing path is provided after the constriction in the direction of flow.

The constriction or the constrictions of the mixer apparatus in accordance with the invention are formed and arranged in such a manner that two oppositely directed eddies form in the flowing fluid when it passes through a constriction. Partial mixing results in the eddies during the flow through the mixing path. In comparison with the known mixer apparatus, fewer mixer elements and only two webs per mixer element are required in order to attain a good mixing effect. A longer tube is, however, required. Furthermore, the mixer apparatus in accordance with the invention causes a lower pressure loss.

BRIEF DESCRIPTION OF THE DRAWINGS

FIG. 4 shows a second embodiment of the insert;

FIG. 5 shows a segment of the insert of FIG. 4;

FIG. 6 shows a third embodiment, namely a tube with a rectangular cross-section;

FIG. 7 shows a variant of the example of FIG. 6; and

FIG. 8 shows a fifth embodiment of an insert.

DESCRIPTION OF THE PREFERRED EMBODIMENTS

Figure 1:
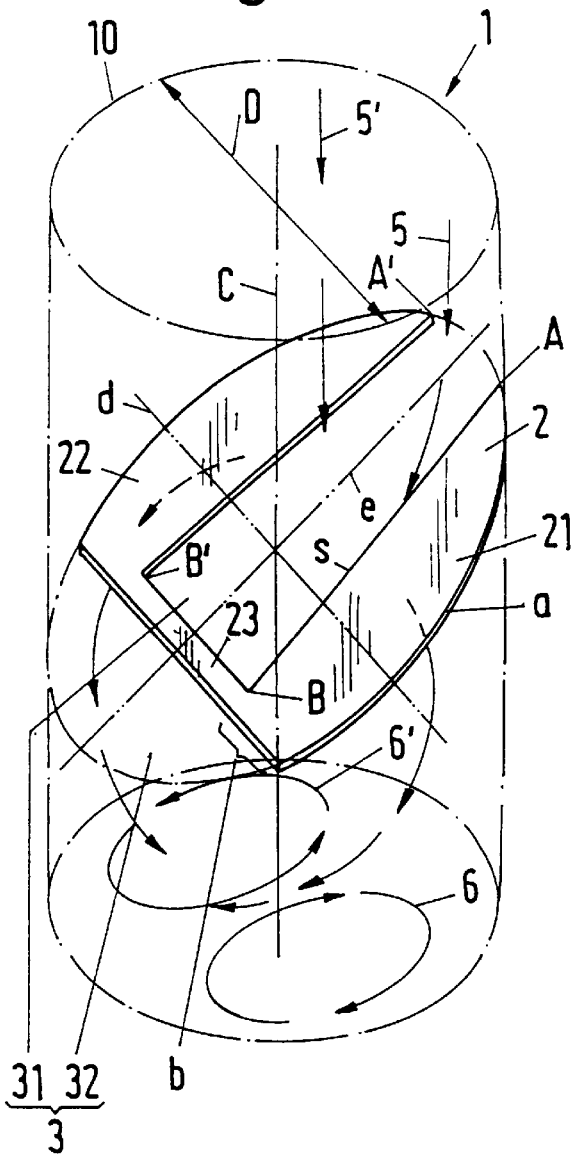
FIG. 1 a first exemplary embodiment of the insert of a mixer tube in accordance with the invention with a circular cross-section.
Figure 2:
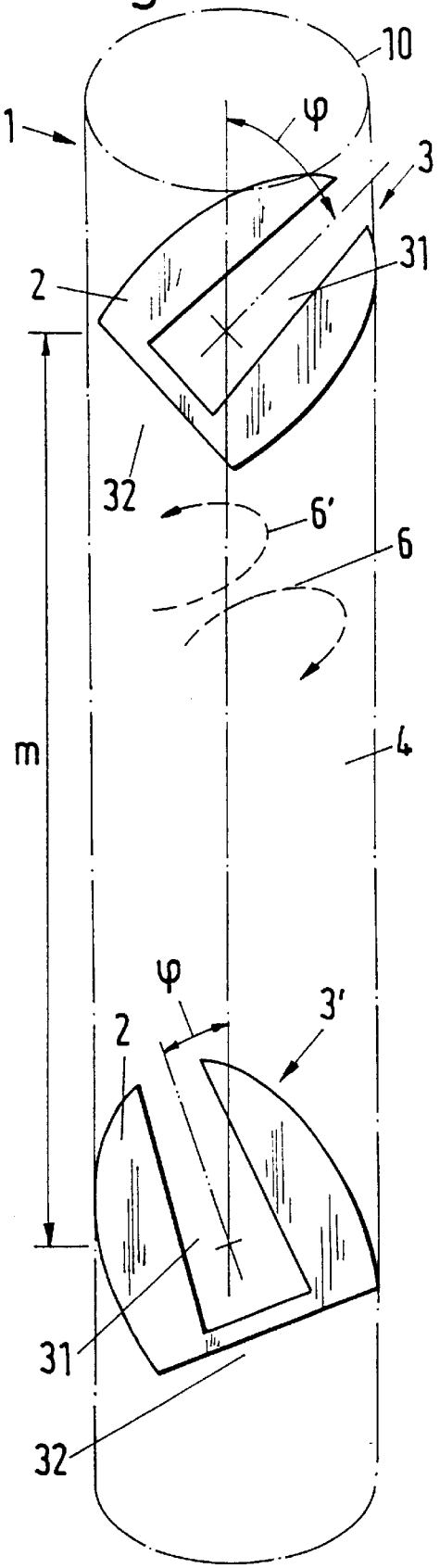
FIG. 2 shows two adjacent inserts of the type in accordance with FIG. 1.

FIGS. 1 and 2 represent a mixer tube 1 in accordance with the invention for low viscosity fluids. The tube wall 10 is only indicated in chain-dotted lines. The circular tube has a diameter D. The mixer tube 1 contains plate-shaped blocking elements 2 as inserts which partially cover or block off the cross-section of the tube 1 at individual locations of the tube 1 and thus produce constrictions or narrow passages 3. The elements 2 are arranged in elliptical surfaces with the main axes d and e.

The constriction 3 left free in the elements 2 comprises two partial regions 31 and 32: a wide gap 31 which extends from the tube wall 10 through the tube axis c to the second partial region 32 along the axis e, and a through-flow opening 32 with an elongate, here crescent-like, shape which borders on the tube wall 10 and is arranged transverse to a first partial region 31. The shape of the second partial region 32 can also be lens-shaped for example.

The axis e (or the gap 31) subtends an angle 100 to the tube axis c which lies in the range between around 20° and 60°, preferably between 35° and 45°. The second partial region 32 is arranged downstream after the gap 31. After the constriction 3 there follows a mixing path 4.

In the normal projection onto a tube cross-section the open area of the constriction 3 amounts to about 50%–70% of the tube cross-section area, with about 60%–70% of the open area being associated with the gap 31. Under these conditions the material requirements are low and the flow of the fluid to be mixed suffers only low pressure losses.

The plate-shaped elements 2 of a constriction 3 form an arrangement with two segments 21 and 22. The edges of these segments comprise substantially the following parts in each case: an edge segment a with the shape of an elliptical arch which borders on the tube wall 10; a straight edge segment s which forms a border of the gap 31; and an edge segment b which borders on the second partial region 32 of the constriction 3. Between the tube wall 10 and the arch-shaped edge a there can be a small gap which can be bridged over at individual locations by a connection means, for example by a welding material. The elliptical edge can be approximated for example by straight elements. In place of the straight edge piece s, a curved one can also be present.

Relatively good mixing effects are obtained even when the segments 21 and 22 are highly shortened and the open area of the constriction amounts to 75%. For such segments 21, 22 the mixing effect is less satisfactory; on the other hand, the pressure drop is lower. This is true in general: larger open areas mean a low pressure drop and vice versa.

In the embodiments of FIGS. 1 and 2 the two segments 21 and 22 are connected to one another via a narrow bridge 23 which lies on the boundary between the two partial regions 31 and 32 of the constriction 3. With this bridge 23 there results an advantageous stabilization with respect to the construction which permits a smaller plate thickness to be chosen for the plate-shaped elements 2 than if the bridge 23 were not present.

The flowing fluid is indicated in FIG. 1 by arrows 5, 5'. The constriction 3 induces two eddies of opposite sense in the flow which are indicated by the arrows 6, 6' in the projection onto a cross-section surface.

The gap 31 is substantially trapezoidal (corner points A, B, B' and A'); it diverges in the direction towards the second partial region 32 of the constriction 3. With this gap shape an ideal eddy pair 6, 6' arises. In order that the two eddies are of equal strength, the constriction 3 is executed to be mirror symmetric; the plane of symmetry lies on the tube axis c.

Figure 3:
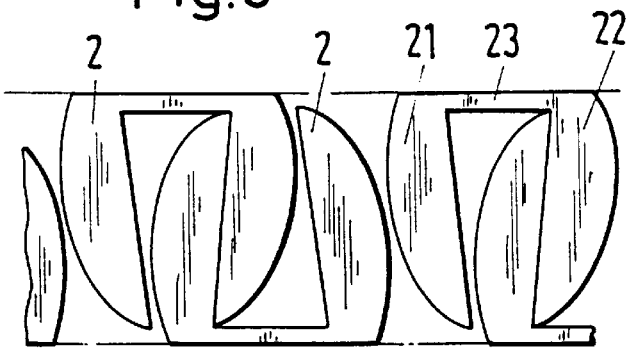
FIG. 3 shows a plurality of inserts cut out of a metal sheet.

The plate-shaped elements 2 associated with the constriction 3 are arranged in a plane in the exemplary embodiment of FIGS. 1 and 2. They can be manufactured together with the connection bridge 23 from a piece of sheet metal. FIG. 3 shows how these elements 2 can be cut out of a strip of sheet metal in a material saving manner.

The plate-shaped elements 2 can be curved or bent instead of planar.

At least two constrictions 3 are provided in the mixer tube 1, where in each case for a first constriction 3 an adjacent downstream constriction 3' is provided outside the mixing path 4 at a distance m defining a mixing path in the range of 1 to 10 tube diameters D, more desirably of about 3 to 5 tube diameters D. The insert-free space between adjoining constrictions 3, 3' thus has a length of about 2 to 4 tube diameters D. The gaps 31 of adjacent constrictions 3, 3' are arranged transverse to one another.

FIGS. 4 to 8 represent further embodiments of possible constrictions 3. In FIG. 4 the two segments 21 and 22, which are similarly shaped, are arranged at an angle to one another. The shape of the segment 21 or 22 respectively can be seen in FIG. 5. The segments 21 and 22 can naturally also be connected by a bridge 23 as shown in chain-dotted lines, for example.

FIGS. 6 and 7 show constrictions 3 for mixer tubes 1 in accordance with the invention whose cross-sections are square or rectangular. FIG. 6 shows in addition that a bridge 23 can be arranged at a location other than at the boundary between the two partial regions of the constriction 3. The bridge 23 can for example be a rod with a circular cross-section.

The fifth exemplary embodiment of FIG. 8 shows a constriction 3 which consists of only one gap-shaped region 31. The region 31 can be trapezoidal (with two curved sides AA', BB') and can diverge in or opposite to the direction of flow.

The mixer tube 1 in accordance with the invention can be used for mixing a fluid with solid substances contained in suspension. This use is especially advantageous when the solid substances are fiber-shaped.

What is claimed is:

1. Mixer tube having a tube wall and a tube cross-section defining a tube axis for low viscosity fluid flow, the mixer tube comprising a plurality of plate-like elements which block off a cross-section of the mixer tube at at least one region of the mixer tube, the plate-like elements having boundaries that define constrictions which are open to fluid flow in a direction of flow through the mixer tube, the plate-like elements comprising at least one set of plate-like elements which are disposed at a level along the tube axis of the mixer tube and which define a mixing path downstream of the set of plate-like elements, the constrictions for the at least one set of plate-like elements including a gap-shaped region bordering the plate-like elements and extending from a portion of the tube wall through the tube axis and subtending an angle relative to the tube axis which ranges from about 20° to 60°, the tube cross-section being generally circular with a tube diameter, wherein the mixing path ranges from 1–10 times the tube diameter.

2. Mixer tube in accordance with claim 1, wherein the gap-shaped region extends from a portion of the tube wall through the tube axis to another portion of the tube wall.

3. Mixer tube in accordance with claim 1, wherein the constrictions for the at least one set of plate-like elements further include a partial region and the gap-shaped region extends from a portion of the tube wall through the tube axis to the partial region.

4. Mixer tube in accordance with claim 3, wherein the at least one set of plate-like elements comprises a pair of plate-like elements that are oppositely disposed relative to the tube axis, each plate-like element having boundaries that comprise a first boundary disposed adjacent a portion of the tube wall, a second boundary which borders a portion of the gap-shaped region, and a third boundary which borders a portion of the partial region.

5. Mixer tube in accordance with claim 4, wherein the first boundary is generally elliptical.

6. Mixer tube in accordance with claim 4, wherein the first boundary is slight spaced from the tube wall.

7. Mixer tube in accordance with claim 4, wherein the at least one set of plate-like elements further comprises at least one bridge which connects between portions of the pair of plate-like elements.

8. Mixer tube in accordance with claim 7, wherein the at least one bridge connects between the second boundaries of the pair of plate-like elements.

9. Mixer tube in accordance with claim 8, wherein the at least one bridge has an edge that connects between a first intersection point defined by the second boundary and third boundary of a first one of the pair of plate-like elements and a second intersection point defined by the second boundary and third boundary of a second one of the pair of plate-like elements.

10. Mixer tube in accordance with claim 4, wherein the pair of plate-like elements are substantially mirror images of one another with a plane of symmetry extending through the tube axis.

11. Mixer tube in accordance with claim 4, wherein the pair of plate-like elements lie substantially in a plane.

12. Mixer tube in accordance with claim 11, wherein the at least one set of plate-like elements further comprises at least one bridge which connects between portions of the pair of plate-like elements and lies substantially in the plane with the pair of plate-like elements.

13. Mixer tube in accordance with claim 12, wherein the pair of plate-like elements and at least one bridge are formed from a single piece of sheet metal.

14. Mixer tube in accordance with claim 3, wherein the partial region forms a through-flow opening bordering between another portion of the tube wall and the at least one set of plate-like elements.

15. Mixer tube in accordance with claim 14, wherein the partial region has a half-moon shape.

16. Mixer tube in accordance with claim 14, wherein the partial region has a lens-like shape.

17. Mixer tube in accordance with claim 1, wherein the gap-shaped region subtends an angle relative to the tube axis which ranges from about 35° to 45°.

18. Mixer tube having a tube wall and a tube cross-section defining a tube axis for low viscosity fluid flow, the mixer tube comprising a plurality of plate-like elements which block off a cross-section of the mixer tube at least one region of the mixer tube, the plate-like elements having boundaries that define constrictions which are open to fluid flow in a direction of flow through the mixer tube, the plate-like elements comprising at least one set of plate-like elements which are disposed at a level along the tube axis of the mixer tube and which define a mixing oath downstream of the set of plate-like elements, the constrictions for the at least one set of plate-like elements including a gap-shaped region bordering the plate-like elements and extending from a portion of the tube wall through the tube axis and subtending an angle relative to the tube axis which ranges from about 20° to 60°, wherein the gap-shaped region has a substantially trapezoidal shape which diverges in the direction of flow through the mixer tube.

19. Mixer tube in accordance with claim 18, wherein the tube cross-section is generally rectangular.

20. Mixer tube in accordance with claim 18, wherein the tube cross-section is generally circular with a tube diameter.

21. Mixer tube in accordance with claim 18, wherein the gap-shaped region extends from a portion of the tube wall through the tube axis to another portion of the tube wall.

22. Mixer tube in accordance with claim 18, wherein the constrictions for the at least one set of plate-like elements further include a partial region and the gap-shaped region extends from a portion of the tube wall through the tube axis to the partial region.

23. Mixer tube in accordance with claim 22, wherein the partial region forms a through-flow opening bordering between another portion of the tube wall and the at least one set of plate-like elements.

24. Mixer tube in accordance with claim 22, wherein the at least one set of plate-like elements comprises a pair of plate-like elements that are oppositely disposed relative to the tube axis, each plate-like element having boundaries that comprise a first boundary disposed adjacent a portion of the tube wall, a second boundary which borders a portion of the gap-shaped region, and a third boundary which borders a portion of the partial region.

25. Mixer tube having a tube wall and a tube cross-section defining a tube axis for low viscosity fluid flow, the mixer tube comprising a plurality of plate-like elements which block off a cross-section of the mixer tube at at least one region of the mixer tube, the plate-like elements having boundaries that define constrictions which are open to fluid flow in a direction of flow through the mixer tube, the plate-like elements comprising at least one set of plate-like elements which are disposed at a level along the tube axis of the mixer tube and which define a mixing path downstream of the set of plate-like elements, the constrictions for the at least one set of plate-like elements including a gap-shaped region bordering the plate-like elements and extending from a portion of the tube wall through the tube axis and subtending an angle relative to the tube axis which ranges from about 20° to 60°, wherein the plurality of plate-like elements comprise sets of plate-like elements disposed at discrete levels along the tube axis of the mixer tube, with a first set of neighboring sets of plate-like elements disposed upstream of a second set of the neighboring set, the second set being downstream of a mixing path for the first set of plate-like elements.

26. Mixer tube in accordance with claim 25, wherein the second set of plate-like elements is spaced from the first set of plate-like elements along the tube axis by a spacing of about 3–5 times the tube diameter.

27. Mixer tube in accordance with claim 25, wherein the second set of plate-like elements is spaced from the first set of plate-like elements along the tube axis such that a tube segment of the mixer tube between the first and second sets of plate-like elements having a length of about 2–4 times the tube diameter is free of the plate-like elements in the tube cross-section.

28. Mixer tube in accordance with claim 25, wherein the gap-shaped region of the first set of plate-like elements extending from a portion of the tube wall through the tube axis is oriented generally transverse to, when projected onto the tube cross-section, the gap-shaped region of the second set of plate-like elements extending from another portion of the tube wall through the tube axis.

29. Mixer tube in accordance with claim 25, wherein the tube cross-section is generally rectangular.

* * * * *